US005230813A

United States Patent [19]

Hintzen

[11] Patent Number: 5,230,813

[45] Date of Patent: Jul. 27, 1993

[54] STATOR AND ROTOR MEMBERS FOR USE IN APPARATUS FOR CLOSING AND/OR REGULATING THE DISCHARGE OR TAPPING OF MOLTEN METAL

[75] Inventor: Ullrich Hintzen, Taunusstein-Watzhahn, Fed. Rep. of Germany

[73] Assignee: Didier-Werke AG, Wiesbaden, Fed. Rep. of Germany

[21] Appl. No.: 805,047

[22] Filed: Dec. 11, 1991

Related U.S. Application Data

[62] Division of Ser. No. 618,947, Nov. 27, 1990, Pat. No. 5,085,344.

[30] Foreign Application Priority Data

Nov. 28, 1989 [DE] Fed. Rep. of Germany ..... 3939241

[51] Int. Cl.[5] ..... B22D 41/14

[52] U.S. Cl. ..... 222/599; 222/597; 222/598

[58] Field of Search ..... 222/597, 598, 599

[56] References Cited

U.S. PATENT DOCUMENTS 3,651,998 3/1972 Rocher ..... 222/598
4,905,876 3/1990 Gimpera ..... 222/598
4,966,314 10/1990 Bruckner et al. ..... 222/598
5,058,784 10/1991 Hintzen et al. ..... 222/598
5,078,306 1/1992 Keller et al. ..... 222/598

*Primary Examiner*—Scott Kastler
*Attorney, Agent, or Firm*—Wenderoth, Lind & Ponack

[57] ABSTRACT

An apparatus for closing and/or regulating the discharge or tapping of molten metal from a metallurgical vessel is formed by a ceramic stator member to be fixed to a metallurgical vessel and having a pipe-shaped portion having extending therethrough at least one lateral opening, and a ceramic rotor member having a pipe-shaped portion having extending therethrough at least one lateral opening. The stator and rotor members are coaxially assembled with the pipe-shaped portion of one member fitted over and surrounding the pipe-shaped portion of the other member. The pipe-shaped portions have radially confronting respective cylindrical inner and outer sealing surfaces onto which open the lateral openings, such inner and outer sealing surfaces sealingly engaging to define a primary seal to prevent leakage of molten metal. The stator and rotor members have respective axially confronting end sealing surfaces. The rotor member is axially movable, i.e. loadable, to press the end sealing surface of the rotor member against the end sealing surface of the stator member at a compaction pressure sufficient to form a secondary seal for preventing leakage of molten metal.

15 Claims, 2 Drawing Sheets

STATOR AND ROTOR MEMBERS FOR USE IN APPARATUS FOR CLOSING AND/OR REGULATING THE DISCHARGE OR TAPPING OF MOLTEN METAL

This application is a division of U.S. application Ser. No. 07/618,947, filed on Nov. 27, 1990, now U.S. Pat. No. 5,085,344.

BACKGROUND OF THE INVENTION

The present invention relates to stator and rotor members for use in an apparatus for closing and/or regulating the discharge or tapping of molten metal from a metallurgical vessel. More particularly, the present invention relates to such members including a refractory or ceramic inner pipe-like element having therethrough at least one lateral opening and a refractory or ceramic outer pipe-like element having therethrough at least one lateral opening, one such element being stationary and forming the stator member, and the other element being rotatably movable relative thereto and forming the rotor member. The pipe-like elements are oriented preferably vertically. The elements have respective pipe-shaped portions through which extend the lateral openings and which also define radially confronting respective cylindrical inner and outer sealing surfaces defining a primary seal to prevent leakage of molten metal. The elements also have generally radially extending annular surfaces that confront each other and that extend annularly around the common longitudinal axis of the two pipe-like elements.

An apparatus of this general type is disclosed in German DE 35 40 202 C1 wherein an outer pipe is rotated with respect to an inner pipe to bring respective openings thereof into and out of alignment to open, close and regulate molten metal tapping or discharge. Cylindrical main sealing surfaces prevent the molten metal from escaping. Accordingly, the gap between the cylindrical sealing surfaces is dimensioned to be so narrow that the molten metal cannot pass therebetween.

Tests have shown however that, when pouring or discharge periods are relatively long, the gap between the main or primary sealing surfaces can expand. The result is that molten metal can pass therebetween when the apparatus is in the closed position, and this of course is very undesirable. A similar apparatus is disclosed in German DE 37 31 600 A1, but such known apparatus also suffers from the same problem.

SUMMARY OF THE INVENTION

With the above discussion in mind, it is an object of the present invention to provide stator and rotor members for use in an apparatus of the above described type, but whereby it is possible to overcome the above and other prior art disadvantages.

It is a further object of the present invention to provide such stator and rotor members whereby it is possible to insure that, when the primary sealing surfaces have become worn or when the gap therebetween expands, the apparatus still can be operated to reliably close and/or regulate the discharge or tapping of molten metal without leakage of the molten metal.

These objects are achieved in accordance with the present invention by the provision that each of the stator and rotor members has respective axially confronting end sealing surfaces that annularly surround the common coaxial axes of the two members, and whereby the rotor member is axially movable, at least when the primary seal between the primary cylindrical sealing surfaces of the two members will not prevent leakage of the molten metal, to press the end sealing surface of the rotor member against the end sealing surface of the stator member at a pressure sufficient to form a secondary seal therebetween that will reliably prevent leakage of the molten metal.

By the above features of the present invention it is possible to ensure that the apparatus has a longer and more reliable operating life, since even when the primary seal defined between the cylindrical sealing surfaces no longer is capable of preventing molten metal leakage, the rotor member can be axially moved relative to the stator member to create therebetween a secondary seal operable to reliably prevent leakage of the molten metal. Thereby it is possible to avoid the danger of molten metal breakthrough, and it also is possible to continue use of the apparatus until it can be conveniently replaced or repaired.

It particularly is contemplated that the rotor be axially movable when the lateral opening or openings of the rotor member are out of alignment and communication with the lateral opening or openings of the stator member. This makes it possible to ensure the prevention of molten metal leakage when the apparatus is in its closed position. In accordance with a further feature of the present invention, the rotor member is axially movable to press the end sealing surface thereof against the end sealinq surface of the stator member at a pressure of from 0.1 to 10 bar, and at any rate at a pressure higher than the pressure of the molten metal in the metallurgical vessel, i.e. the hydrostatic pressure. One skilled in the art readily would understand the pressures that would be necessary to achieve the functioning of the present invention in a particular installation.

In accordance with a yet further feature of the present invention, each member includes a pipe-shaped portion through which extends the respective lateral opening and which is defined by the respective cylindrical sealing surface and also by respective first and second axially spaced end sealing surfaces, with the cylindrical sealing surface extending between the respective first and second end sealing surfaces. The first and second end sealing surfaces of one member axially confront respective first and second end sealing surfaces of the other member. By at least slight axial movement of the rotor member toward the stator member, the first and second end sealing surfaces of the rotor member press against the respective first and second end sealing surfaces of the stator member at a force or compaction sufficient to withstand the pressure of the molten metal and to prevent molten metal leakage therebetween. Thereby, there are defined two axially spaced secondary seals on opposite axial ends or sides of the lateral openings. The first and second end sealing surfaces of each member extend in opposite radial directions from their respective cylindrical surface thereof. The stator member can be the outer member and the rotor member can be the inner member, or alternatively the rotor member may be the outer member and the stator member may be the inner member.

In accordance with a further feature of the present invention, the end sealing surfaces may be defined by inserts, for example refractory inserts of materials that would be well understand by one skilled in the art to be capable of achieving the function of the present invention. Furthermore, the end sealing surfaces may be planar or non-planar. Particularly, the end sealing surfaces may be conical or may have a profiled configuration in respective radial directions.

BRIEF DESCRIPTIONS OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
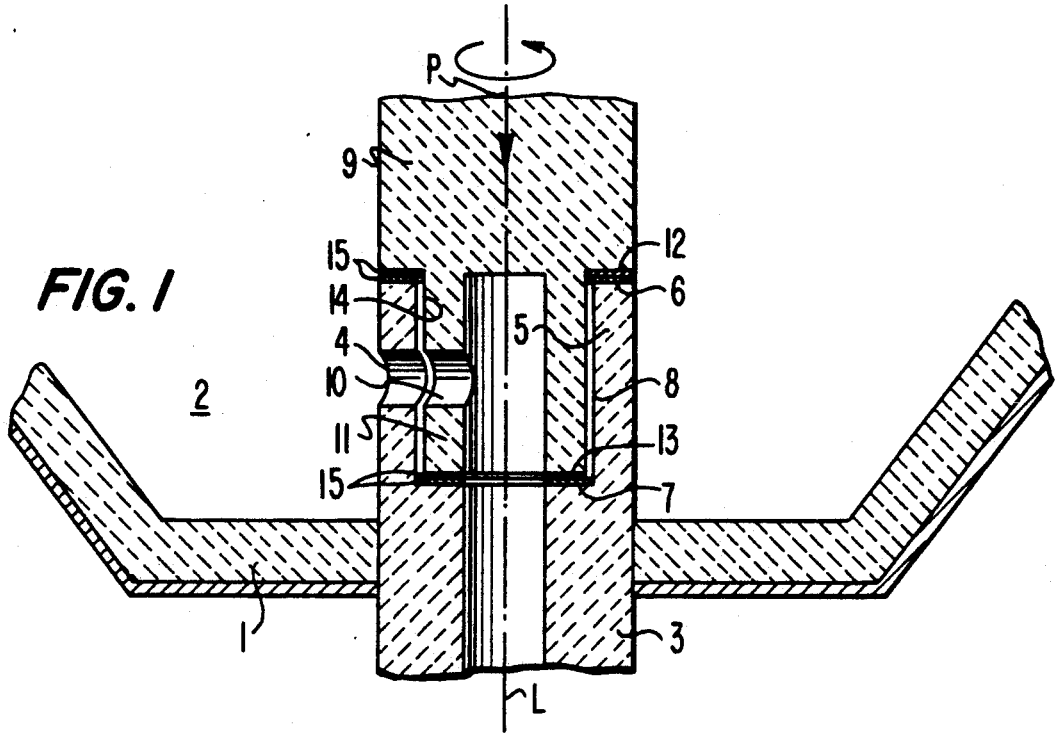
FIG. 1 is a sectional view through a bottom portion of a metallurgical vessel having installed therein an apparatus formed by stator and rotor members in accordance with a first embodiment of the present invention.

In FIG. 1 there is schematically shown a portion of the bottom of the metallurgical vessel to contain molten metal and including a refractory lining 1 and a conventional outer metal shell or jacket. Fixed to and extending through the bottom of the metallurgical vessel, preferably to extend vertically, is a refractory or ceramic stator member 3 having therethrough a longitudinal passage for the discharge of molten metal and a longitudinal axis L. Rotatably mounted with respect to stator member 3 is a refractory or ceramic rotor member 9 rotatable in the direction of the arrow relative to the stator member. Rotor member 9 has therein, at least partially, a passage in alignment with the passage through the stator member.

The stator and rotor members have respective pipe-shaped portions 5, 11 coaxial about longitudinal axis L that is common to both members. In other words, rotor member 9 is rotatable relative to stator member 3 about axis L. The two members are coaxially assembled with the pipe-shaped portion of one member fitted over and surrounding the pipe-shaped portion of the other member. In the embodiment of FIG. 1, pipe-shaped portion 5 of stator member 3 fits over pipe-shaped portion 11 of rotor member 9. The arrangement is just the opposite in the embodiment of FIG. 2, i.e. pipe-shaped portion 11 of rotor member 9 fits over pipe-shaped portion 5 of stator member 3.

In both embodiments, the pipe-shaped portions 5, 11 have extending therethrough lateral openings 4, 10 respectively, such lateral openings being at the same level axially of the apparatus. In the illustrated arrangement, each member has therethrough a single opening, but plural openings in one or both of the members could be provided, as would be understood by one skilled in the art. Thus, by rotation of rotor member 9 and relative to stator member 3, opening 10 may be brought into and out of alignment with opening 4, thereby to selectively open, regulate and close the discharge or tapping of molten metal from the interior 2 of the metallurgical vessel through the apparatus.

The pipe-shaped portions 5, 11 have respective radially confronting surfaces 8, 14 that are complementary and circular in transverse cross section, preferably cylindrical. These surfaces are dimensioned such that the gap therebetween is so small that melt cannot pass therebetween. Thus, surfaces 8, 14 are primary sealing surfaces that define a primary seal to prevent leakage of molten metal. Particularly, when the apparatus is in the closed position with openings 4, 10 totally out of communication, the primary seal prevents the hydrostatic pressure of the molten metal within the metallurgical vessel from causing leakage of the molten metal through the primary seal.

During the course of time however, the gap between main sealing surfaces 8, 14 can become widened, for example by wear of such surfaces or by expansion of the members. When this occurs, then leakage of molten metal between such surfaces can occur, particularly when the apparatus is in the closed position.

In accordance with the present invention however, when such condition exists, i.e. when the gap between the primary sealing surfaces 8, 14 has expanded to enable molten metal to pass therebetween, it is possible to form secondary seals which will prevent such molten metal leakage. Particularly, each pipe-shaped portion 5, 11 is defined by axially spaced opposite end sealing surfaces. Thus, pipe-shaped portion 5 is in the form of a step defined by axially spaced opposite end sealing surfaces 6, 7. Similarly, pipe-shaped portion. 11 is in the form of a step defined by axially spaced opposite end sealing surfaces 12, 13. In accordance with the present invention, the rotor member 9 can be loaded with a compaction pressure in the direction of arrow P sufficient to form secondary seals that will prevent leakage of the molten metal. It is described herein that the rotor member is axially moved toward the stator member to achieve such secondary sealing. By this it is contemplated that only very slight movement actually will occur, sufficient to load rotor member 9 to press the end sealing surfaces 12, 13 thereof against respective end sealing surfaces 6, 7 of the stator member to provide the necessary sealing function. Thus, the confronting end sealing surfaces form secondary seals. It is of course to be understood that it would not be absolutely necessary to require two secondary seals. Rather, the function of the invention could be achieved by providing only a single such secondary seal by confronting end sealing surfaces, for example the upper confronting end sealing surfaces or the lower confronting end sealing surfaces. The actual structure or means to achieve this axial compaction is not shown. One skilled in the art however readily would understand various structures and devices that could be employed to achieve such axial loading and compaction to result in the function of the present invention, i.e. the creation of one or more secondary seals sufficient to prevent molten metal leakage in a given installation.

The compaction pressure always will be greater than the pressure Ds of the melt, i.e. hydrostatic pressure, that is a function of the molten metal level h. Thus, the pressure of the molten metal will be:

$$Ds = h \times Rs \times g$$

where Rs is the density of the melt and g is acceleration due to gravity. It is contemplated that suitable compaction pressures will range from 0.1 bar to 10 bar.

Figure 2:
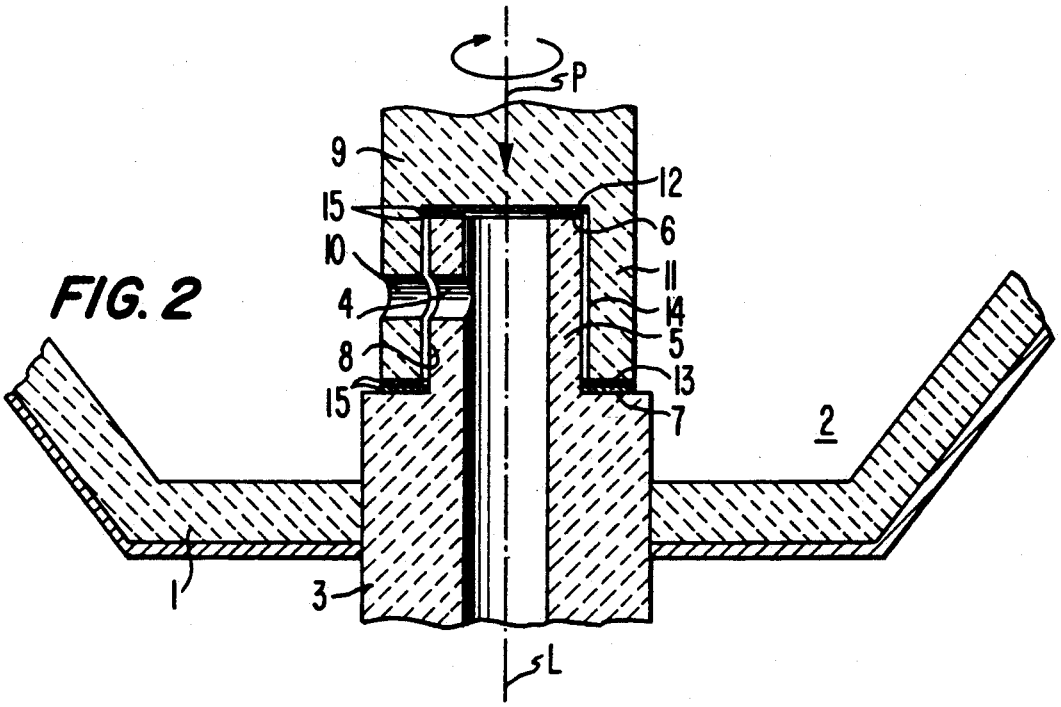
FIG. 2 is a view similar to FIG. 1 but illustrating a second embodiment of the present invention.
Figure 3:
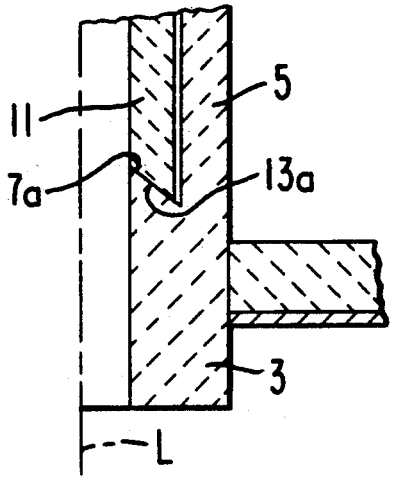
FIGS. 3 and 4 are partial views similar to FIG. 1 but illustrating further embodiments of the invention.
Figure 4:
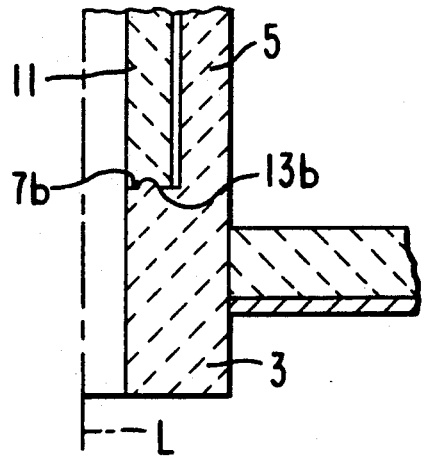

End sealing surfaces 6, 7, 12, 13 can be actual end surfaces of the members 3, 9. Such end surfaces thus can be made of the same material as members 3, 9. However, as illustrated in FIGS. 1 and 2 of the drawings it also is possible to provide inserts 15 to define end sealing surfaces 6, 7, 12, 13. Such inserts 15 can be made of suitable materials as would be understood by one skilled in the art. It particularly is contemplated that such inserts 15 could be formed of oxide ceramic materials such as $Al_2O_3$ of $ZrO_2$. Such inserts 15 also could be made of boron nitrite and/or graphite.

The confronting end sealing surfaces 6, 12 and/or 7, 13 do not have to be pushed continuously against each other by the compaction pressure required for sealing. It is sufficient if such end sealing surfaces are subjected to such compaction pressure only if the primary sealing surfaces 8, 14 themselves no longer are adequate to perform the primary sealing function. In such case it of course would be necessary to first determine the inadequacy of the primary seal. To avoid the necessity for such detection, the rotor member 9 always can be loaded with the compaction pressure when the rotor member 9 is in its closed position. It would not be advantageous to load the rotor member 9 with the compaction pressure when the rotor member is being rotated, since the compaction pressure then would make rotation more difficult and the end sealing surfaces would be stressed upon such rotation.

In the embodiments illustrated the end sealing surfaces all are planar and extend radially of common axis L. Such surfaces however also could be non-planar, for example conical. Also, such non-planar surfaces could be radially profiled to form a labyrinth configuration that would further impede leakage of the molten metal.

Although the present invention has been described and illustrated with respect to preferred embodiments thereof, it is to be understood that various modifications and changes could be made to the specifically described and illustrated features without departing from the scope of the present invention. For example, whereas the rotor is shown as being within the interior of the metallurgical vessel and operable from above, it is possible that the rotor member could be inserted from below through the metallurgical vessel and operable from below. Other possible modifications as would be understood by one skilled in the art also are included within the scope of the present invention.

We claim:

1. A ceramic stator member for cooperation with a ceramic rotor member to form an apparatus for closing and regulating the discharge or tapping of molten metal from a metallurgical vessel, said stator member being adapted to be fixed to the metallurgical vessel and comprising:

a pipe-shaped portion having extending therethrough at least one lateral opening;

said pipe-shaped portion having a cylindrical sealing surface onto which opens said at least one lateral opening and adapted to radially confront and seal with a complementary sealing surface of the rotor member to thereby define a primary seal to prevent leakage of molten metal; and an annular end sealing surface adjoining and extending from said cylindrical sealing surface and adapted to axially confront and seal with a complementary end sealing surface of the rotor member to define a secondary seal means for preventing leakage of molten metal, said annular end sealing surface being defined by a refractory insert.

2. A stator member as claimed in claim 1, wherein said pipe-shaped portion is defined by first and second axially space said end sealing surface with said cylindrical sealing surface extending between said first and second end sealing surfaces.

3. A stator member as claimed in claim 2, wherein said first and second end sealing surfaces extend in opposite radial directions from said cylindrical sealing surface.

4. A stator member as claimed in claim 1, wherein said end sealing surface is planar.

5. A stator member as claimed in claim 1, wherein said end sealing surface is non-planar.

6. A stator member as claimed in claim 1, wherein said end sealing surface is radially profiled.

7. A ceramic rotor member for cooperation with a ceramic stator member to form an apparatus for closing and regulating the discharge or tapping of molten metal from a metallurgical vessel, said rotor member being adapted to be mounted for rotary and at least slight axial movement relative to the stator member, said rotor member comprising:

a pipe-shaped portion having extending therethrough at least one lateral opening;

said pipe-shaped portion having a cylindrical sealing surface onto which opens said at least one lateral opening and adapted to radially confront and seal with a complementary sealing surface of the stator member to thereby define a primary seal to prevent leakage of molten metal; and an annular end sealing surface adjoining and extending from said cylindrical sealing surface and adapted to axially confront and seal with a complementary end sealing surface of the stator member upon axial movement of said rotor member, to thus define a secondary seal means for preventing leakage of molten metal, said annular end sealing surface being defined by a refractory insert.

8. A rotor member as claimed in claim 7, wherein said pipe-shaped portion is defined by first and second axially spaced said end sealing surfaces with said cylindrical sealing surface extending between said first and second end sealing surfaces.

9. A rotor member as claimed in claim 8, wherein said rotor member is axially movable to press said first and second end sealing surfaces thereof against respective first and second end sealing surfaces of the stator member, thereby defining two axially spaced secondary seals on opposite axial sides of said lateral opening.

10. A rotor member as claimed in claim 8, wherein said first and second end sealing surfaces extend in opposite radial directions from said cylindrical sealing surface.

11. A rotor member as claimed in claim 7, wherein said end sealing surface is planar.

12. A rotor member as claimed in claim 7, wherein said end sealing surface is non-planar.

13. A rotor member as claimed in claim 7, wherein said end sealing surface is radially profiled.

14. A stator member as claimed in claim 5, wherein said end sealing surface is conical.

15. A rotor member as claimed in claim 12, wherein said end sealing surface is conical.

* * * * *